United States Patent [19]

Keren

[11] 4,018,034

[45] Apr. 19, 1977

[54] PACKAGING APPARATUS

[75] Inventor: Eitan Keren, Wayne, N.J.

[73] Assignee: Sealed Air Corporation, Fair Lawn, N.J.

[22] Filed: Nov. 20, 1975

[21] Appl. No.: 633,823

[52] U.S. Cl. ..... 53/390; 53/219

[51] Int. Cl.[2] ..... B65B 67/10

[58] Field of Search ..... 53/390, 219; 83/649; 225/46

[56] References Cited

UNITED STATES PATENTS

| | | | |
|---|---|---|---|
| 2,987,864 | 6/1961 | Miller | 53/390 |
| 3,348,356 | 10/1967 | Curtis | 53/390 X |
| 3,516,228 | 6/1970 | Fellner | 53/390 |

*Primary Examiner*—Travis S. McGehee
*Attorney, Agent, or Firm*—Eugene E. Geoffrey, Jr.

[57] ABSTRACT

Apparatus for dispensing a packaging material and for packaging articles which includes a support for a roll of packaging material and a concave table for receiving articles to be packaged. The material is drawn over the table and by reason of the concavity, the articles are automatically centered on the material so that the material can be folded over the articles and sealed along the edges.

5 Claims, 8 Drawing Figures

PACKAGING APPARATUS

Figure 1:
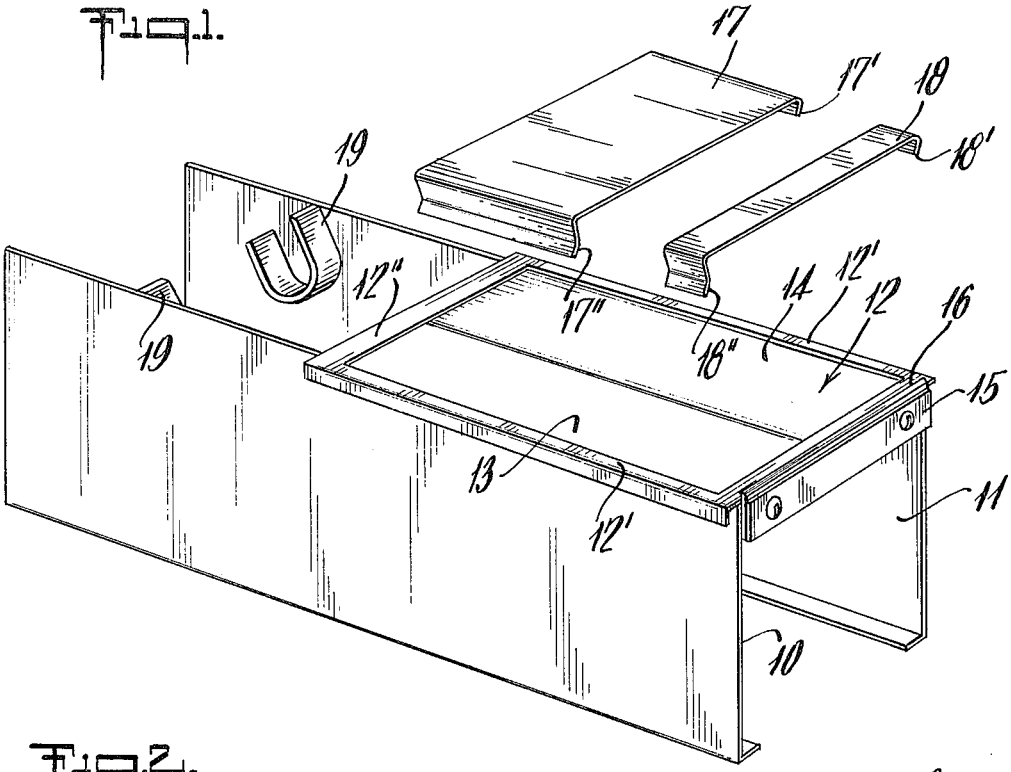

This invention relates to packaging apparatus and more specifically to novel and improved apparatus having provision for both dispensing the packaging material from a roll and receiving the articles to be wrapped so that the wrapping operation can be effected rapidly and efficiently.

Known dispensers for packing materials in the form of rolls are arranged for dispensing gummed paper, plastic tape and the like and include means for severing a length of tape for use in sealing wrapped packages. When packaging small articles, plastic or paper bags are generally used and means must be employed to seal the bags to complete the packaging operation.

This invention has as one of its objects the provision of apparatus including a dispenser and an associated packing table for packaging articles so that the packaging operation can be completed on the apparatus and the completed package then severed from the strip of packaging material preparatory to the next packaging operation.

Another object of the invention resides in the provision of a novel and improved dispenser having provision for dispensing a self-sealing packaging material and means for receiving the article or articles to be packaged so that the material can be securely sealed about the edges to complete the package before removal from the dispenser. This is of particular importance when packaging a plurality of small items since they can be retained within a small area to facilitate packaging.

Still another object of the invention resides in the provision of a novel and improved dispenser for both dispensing the packing material and completing the package that is characterized by its simplicity, ease of operation, and relatively low cost.

A still further object of the invention resides in the provision of novel and improved packaging apparatus.

The apparatus in accordance with the invention comprises means for holding a roll of self-sealing material of a selected width. A packing table having a slight V shaped concavity is disposed forwardly of the roll and at least one plate shorter in length than the table overlies and slidably engages the sides of the table. With this arrangement, material from the roll is drawn over the table with the sealing side up. The article or articles to be packaged are placed on the material whereupon the material is folded upon itself and the two layers cohered about the edges. Cutting means at the outer edge of the table is utilized to sever the completed package from the strip of material preparatory to the next packaging operation. By selecting an appropriate table size and material width, articles of a wide variety of sizes may be readily packaged.

The above and other objects and advantages of the invention will become more apparent from the following description and accompanying drawings forming part of this application.

Figure 2:
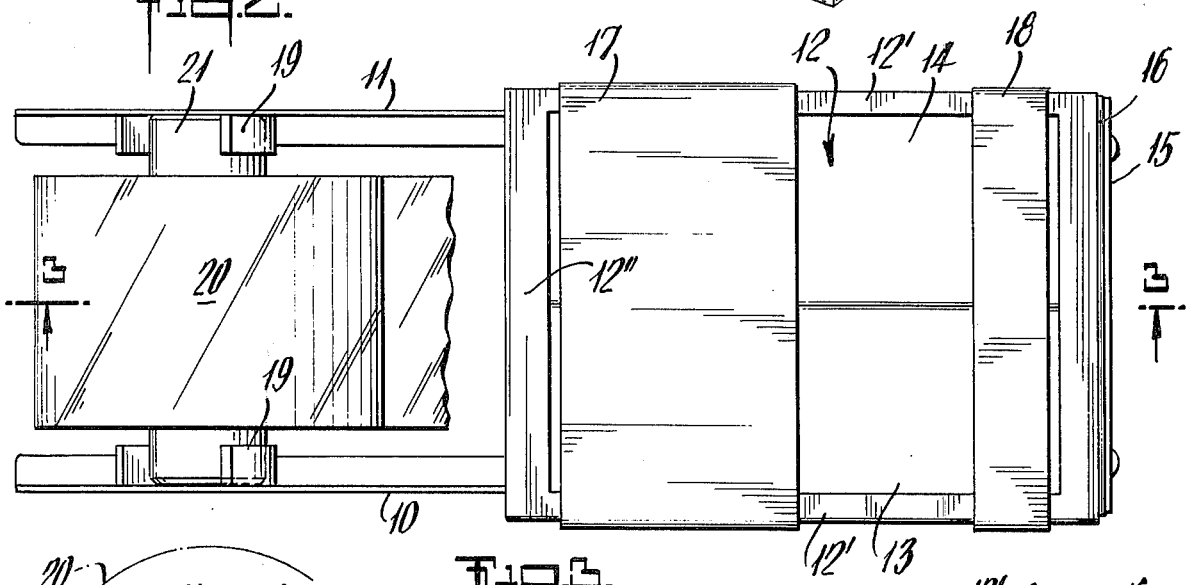
Figure 3:
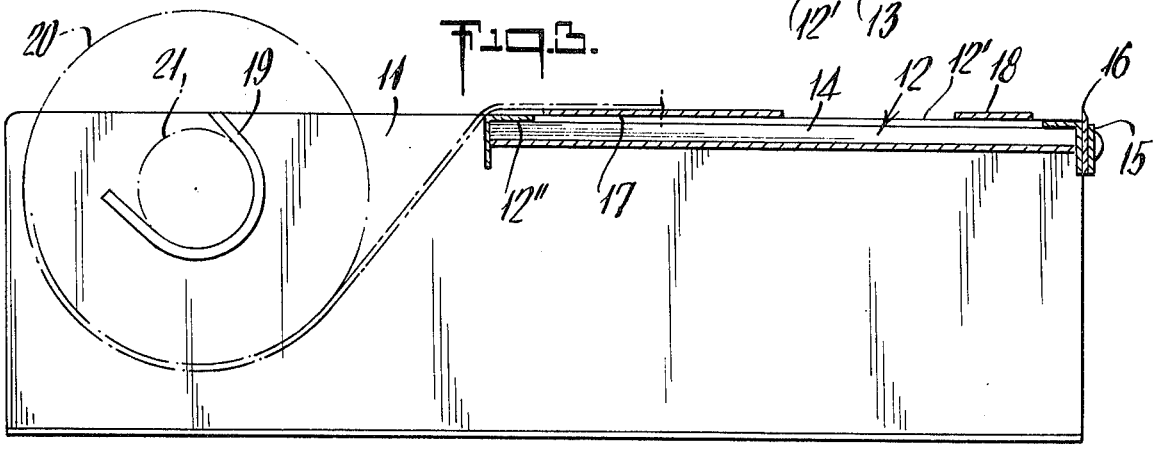
Figure 4:
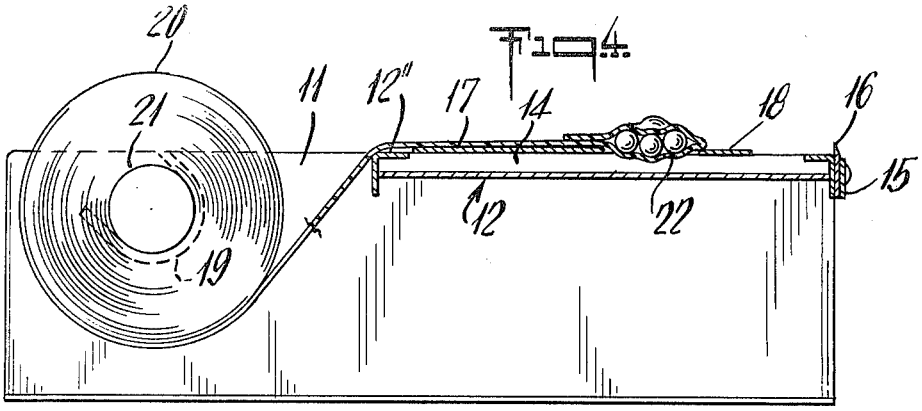
Figure 5:
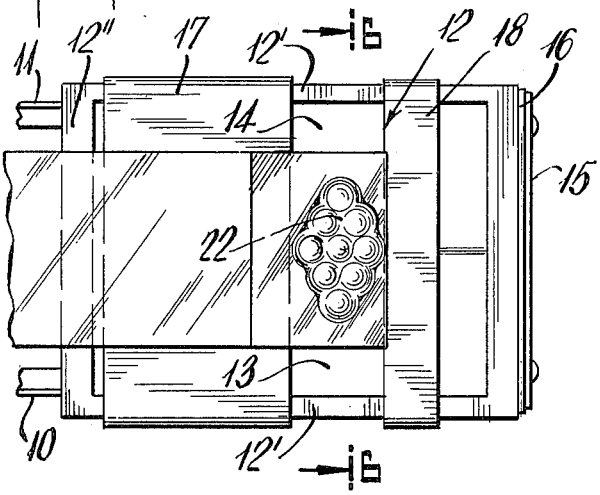
Figure 6:
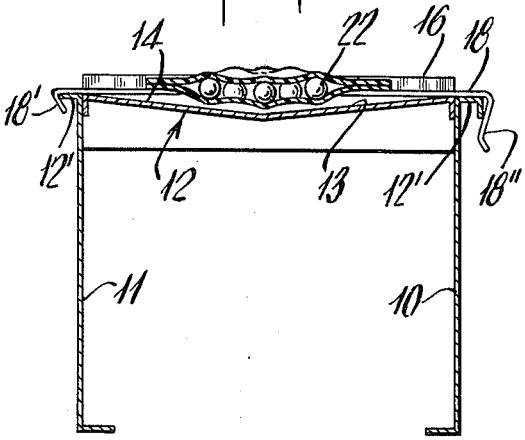
Figure 7:
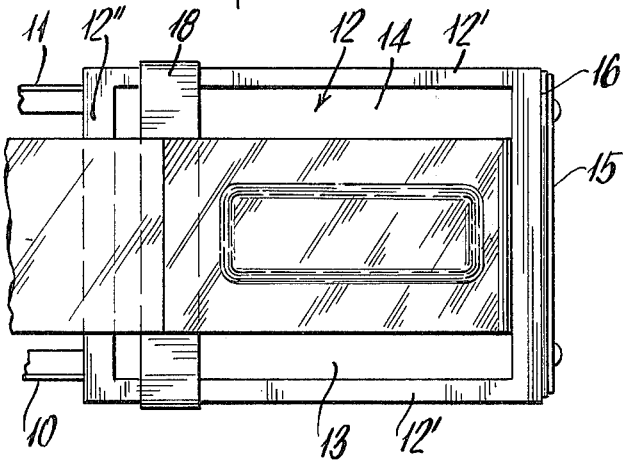
Figure 8:
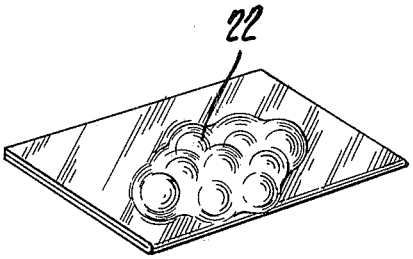

In the drawings:

FIG. 1 is a perspective, partially exploded view of one embodiment of the invention, FIG. 2 is a plan view of the structure shown in FIG. 1 with the roll of packing material disposed therein, FIG. 3 is a cross-sectional view of FIG. 2 taken along the line 3—3 thereof, FIG. 4 is a cross-sectional view similar to FIG. 3 showing one step in the packaging process of small articles, FIG. 5 is a top view of the structure shown in FIG. 4 and illustrating another step in the packaging process, FIG. 6 is a cross-sectional view of FIG. 5 taken along the line 6—6 thereof, FIG. 7 is a view similar to FIG. 5 illustrating the packaging of a large article, and FIG. 8 is a perspective view of a completed package.

Referring now to the drawings and more specifically to FIGS. 1 to 3, the dispensing and packaging apparatus in accordance with the invention is in the form of a generally rectangular structure having side walls 10 and 11 and a top wall or packaging table 12 which extends from one end of the side walls to a point spaced from the other end thereof. The table 12 consists of two inwardly and downwardly extending portions 13 and 14 to provide a slight concavity throughout its length. A transverse member 15 having an upwardly extending cutting edge 16 is positioned along the front edge of the table 12. A pair of plates 17 and 18 are arranged to span the table 12 and have downwardly extending flange-like means 17'-17'' and 18'-18'' to releasable engage outwardly extending edges 12' of the table. These plates are adjustable lengthwise of the table 12 to facilitate packaging operations as will be described.

The portions of the side walls 10 and 11 extending to the rear of the table 12 each carry a U-shaped bracket 19 with the legs thereof extending upwardly and slightly to the rear for support of a roll of packaging material 20 having a central hub 21 engaging the U-shaped brackets 19. The packaging material 20 is preferably formed of plastic having a self-sealing layer on the outer side thereof when the material is drawn over plates 17 and 18 as illustrated in FIG. 3.

In performing the packaging operation, the plates 17 and 18 are positioned in spaced relationship with the distance between them being sufficient to accommodate the article or articles 22 to be packaged. The distance of the innermost edge of plate 18 from the cutting edge 16 should also be adjusted so that adequate material is provided between the edge of the plate and the cutting edge so it can be folded over the articles and have sufficient length to provide a seal with the material overlying plate 17. After sealing the side edges and the top edge of the overlying layer of material with the articles disposed therebetween, the package is then drawn beyond the cutting edge and severed from the strip of material. It is obvious from the foregoing that the plates 17 and 18 may be placed in any desired position to appropriately accommodate the size or quantity of the articles to be packaged. When packaging an article of substantial length as shown in FIG. 7, the plate 17 may be removed entirely and sufficient material is drawn beyond the cutting edge to enclose the article. Upon placement of the article in the position shown, the material is folded thereover and sealed to the underlying material in the same manner previously described. Larger articles may also be accommodated by removing both plates 17 and 18 and using the rear edge 12'' of the table to facilitate sealing of the two layers together.

While only one embodiment of the invention is illustrated and described, it is apparent that alterations, changes and modifications may be made without departing from the true scope and spirit thereof.

What is claimed is:

1. Packaging apparatus for articles comprising a frame including means for supporting a roll of self-sealing packaging material in strip form, a table carried by said frame, said table being concave to receive an article or articles to be packaged, cutting means disposed along the outer edge of said table and means transversely bridging said concave table and spaced from said cutting means whereby articles to be packaged are placed on said packaging material overlying said table and centered by said concavity and said material upon being folded over upon itself and at least partially overlying said bridging member and sealed about the edges to complete the packaging is severed from said strip by said cutting means.

2. Packaging apparatus for articles comprising a frame including means for supporting a roll of self-sealing packaging material in strip form, a table carried by said frame, said table being concave to receive an article or articles to be packaged, and cutting means disposed along the outer edge of said table whereby articles to be packaged are placed on said packaging material overlying said table and centered by said concavity and said material upon being folded over upon itself and sealed about the edges to complete the package is severed from said strip by said cutting means, at least one plate removably bridging and slidably engaging the edges of said table to effectively reduce the length of said table and limit the area on which the articles to be packaged are retained.

3. Packaging apparatus for articles comprising a frame including means for supporting a roll of self-sealing packaging material in strip form, a table carried by said frame, said table being concave to receive an article or articles to be packaged, and cutting means disposed along the outer edge of said table whereby articles to be packaged are placed on said packaging material overlying said table and centered by said concavity and said material upon being folded over upon itself and sealed about the edges to complete the package is severed from said strip by said cutting means, at least two plates of different widths removably bridging and slidably engaging the edges of said table to facilitate limitation of the table area on which the articles to be packaged are retained.

4. Packaging apparatus for articles comprising a frame including means for supporting a roll of self-sealing packaging material in strip form, a table carried by said frame, said table being concave to receive an article or articles to be packaged, and cutting means disposed along the outer edge of said table whereby articles to be packaged are placed on said packaging material overlying said table and centered by said concavity and said material upon being folded over upon itself and sealed about the edges to complete the package is severed from said strip by said cutting means, said table comprised two inwardly and downwardly inclined surfaces extending rearwardly of the cutting edge and bounded by flat edge portions with the side edge portions projecting beyond said frame and at least one plate bridging said table and having means removably engaging said side edge portions.

5. Packaging apparatus according to claim 4 including a second plate bridging said table and having means slidably engaging the side edges thereof.

* * * * *